United States Patent [19]

Klomp

[11] 3,995,609

[45] Dec. 7, 1976

[54] INTERNAL COMBUSTION ENGINE FUEL CONTROL ARRANGEMENT

[75] Inventor: Edward D. Klomp, Mount Clemens, Mich.

[73] Assignee: General Motors Corporation, Detroit, Mich.

[22] Filed: Apr. 21, 1975

[21] Appl. No.: 570,249

[52] U.S. Cl. ..... 123/188 S; 123/131; 123/188 UA; 261/DIG. 55

[51] Int. Cl.[2] ..... F01L 3/00

[58] Field of Search ..... 123/90.67, 131, 141, 123/188 R, 188 AF, 188 S, 188 UA, 188 GC; 261/DIG. 55

[56] References Cited

UNITED STATES PATENTS

| | | | |
|---|---|---|---|
| 1,437,016 | 11/1922 | Riotte | 123/131 |
| 2,753,859 | 7/1956 | Bartlett | 123/188 S |
| 3,028,850 | 4/1962 | Gleeson | 123/188 S |
| 3,640,261 | 2/1972 | Jojey | 123/188 S |
| 3,653,368 | 4/1972 | Scherenberg | 123/188 S |
| 3,820,522 | 6/1974 | Scherenberg | 123/188 S |
| 3,903,855 | 9/1975 | Klakulak et al. | 123/188 UA |

*Primary Examiner*—Wendell E. Burns
*Assistant Examiner*—David D. Reynolds
*Attorney, Agent, or Firm*—Ronald L. Phillips

[57] ABSTRACT

An internal combustion engine having an air flow sensitive fuel sink-distribution-source arrangement that intercepts the liquid fuel film on the intake passage wall adjacent the intake port entry to the combustion chamber and accumulates this fuel on reduced air flow and releases the accumulated fuel to the intake port on increased air flow while distributing the accumulated fuel about the intake port.

3 Claims, 2 Drawing Figures

INTERNAL COMBUSTION ENGINE FUEL CONTROL ARRANGEMENT

This invention relates to an internal combustion engine fuel control arrangement and more particularly to such an arrangement that accumulates fuel from the intake passage wall adjacent the entry to the combustion chamber on reduced air flow and releases the accumulated fuel on increased air flow while also distributing the accumulated fuel about the entry.

In internal combustion engines, both reciprocating and rotary, fuel passes through the intake passage to each combustion chamber as a vapor, as suspended liquid droplets and as a liquid film along the intake passage surface or wall. There is evidence that the liquid fuel film is not uniform over the intake passage wall and because of surface tension flows in rivulets. The fraction of total fuel flowing along the intake passage wall depends on many factors including carburetor and manifold design, type of fuel and engine operating conditions and can be considerable. Furthermore, it has been found that fuel tends to puddle at the termination of the intake passage, hereinafter referred to as the intake port, while the intake port is closed to the combustion chamber thus causing poor mixture preparation in the initial portion of the fuel charge. Furthermore, it is known that during deceleration the reduced air flow that results from closing the throttle tends to decrease and thus adversely affect the air-fuel ratio. One reason for this is that the fuel flowing along the intake passage wall cannot respond to a decrease in demand as rapidly as the air, fuel vapor and fuel droplets. On the other hand, on an acceleration the flow of air vapor mixture will increase almost as rapidly as the throttle can be opened, but the rate of fuel flow along the wall will not respond so rapidly. As a result, there is an instantaneous increase in air-fuel ratio during acceleration and this is the reason for the acceleration pump used in most carburetors, the accelerating pump acting to prevent the engine from stumbling but unfortunately causing a rich spike in the variation of air-fuel ratio with time and a corresponding spike in hydrocarbon (HC) emissions. Furthermore, it is known that there can be cycle-to-cycle variations in air-fuel ratio even during steady state operation because of unpredictable transient variations in liquid fuel flow.

According to the present invention there is provided an air-flow sensitive fuel sink-distribution-source arrangement of very simple structure that intercepts the liquid film on the intake passage wall adjacent the intake port opening to the combustion chamber and is effective to accumulate this fuel on reduced air flow and release the accumulated fuel to the intake port on increased air flow. In the preferred embodiment the fuel sink-distribution-source arrangement simply comprises a porous metal insert mounted in the intake passage adjacent and about the intake port. The porous metal insert has the inherent ability to absorb the liquid fuel flowing along the walls, particularly the rivulets, and advantageously distribute this fuel around the periphery of the intake port. In addition the porous metal insert reacts to the air flowing therepast wherein with reduced air flow, the rate of liquid fuel flow from the porous metal immediately reduces so that it then functions as a sink thus reducing the liquid flow to the intake port when it is very desirable to do so. On the other hand, on an acceleration the flow of air past the porous metal insert will increase with the result that accumulated fuel in the porous metal insert is released and at a rate that increases with increasing throttle opening. Thus, this simple porous metal insert could possibly eliminate the much more expensive acceleration pump or at least reduce its required capacity by providing a fuel sink very near the intake port.

An object of the present invention is to provide a new and improved internal combustion engine fuel control arrangement.

Another object is to provide in an internal combustion engine a simple air flow sensitive fuel sink-distribution-source arrangement that intercepts the liquid fuel film adjacent the intake port opening to the combustion chamber and distributes the fuel around the periphery of the intake port and also accumulates the fuel on reduced air flow and releases the accumulated fuel to the intake port on increased air flow.

Another object is to provide in an internal combustion engine a porous material arrangement that is effective to intercept the liquid fuel film on the intake passage wall adjacent the intake port and accumulate this fuel on reduced air flow and release the accumulated fuel to the intake port on increased air flow while also distributing the accumulated fuel about the intake port.

These and other objects of the present invention will be more apparent from the following description and drawing in which.

Figure 1:
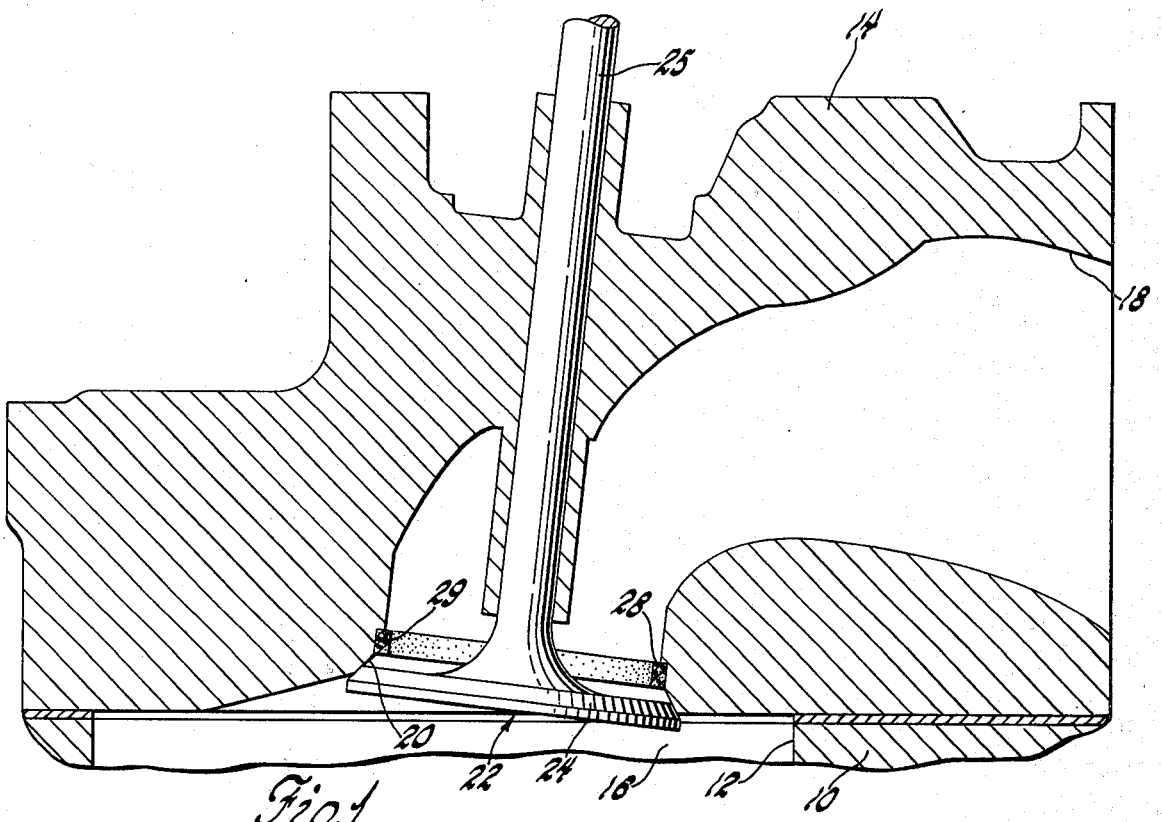
FIG. 1 is a view with parts in section of a fuel control arrangement according to the present invention as installed in a reciprocating piston engine of which only certain parts are shown.

The invention is disclosed in one embodiment in FIG. 1 in a conventional reciprocating piston engine having a block 10 with one or more cylinders 12 and a cylinder head 14 which is bolted to the block and closes the top end of the cylinders 12 to form a combustion chamber 16 above each of the pistons, not shown. For each combustion chamber there is an intake passage 18 in the head 14 that terminates at a circular intake port 20 open to the top of the chamber. In each intake passage 18 there is located an intake valve 22 of the poppet type having a head 24 seatable on a conical seat in the intake port 20. The valve stem 25 is guided in a bore in head 14 and is reciprocated by a conventional cam and spring arrangement, not shown, to cause the valve head to open and close the intake port 20 at the proper time. Suitable air-fuel control and delivery means such as a carburetor and intake manifold, not shown, deliver a controlled supply of fuel and air to the intake passage 18 to meet the varying power demands. In addition, a conventional exhaust valve arrangement, not shown, also of the poppet type operates to exhaust the products of combustion from the combustion chamber.

To understand the present invention it is important to know that during engine operation the fuel passes through the intake passage 18 to the intake port 20 as a vapor, as suspended liquid droplets and as a liquid film along the intake passage surface or wall. Furthermore, there is evidence that the film is not uniform over the surface but because of surface tension the fuel flows in rivulets along the intake passage wall thus providing unequal fuel distribution about the open area of the intake port during flow to the combustion chamber. The fraction of total fuel flowing along the intake passage wall depends on many factors including carburetor design, manifold design, fuel type and engine operating conditions, and can be considerable. Furthermore, it has been found that fuel tends to puddle at the intake valve during the valve-closed duration and can upset the initial portion of the subsequent charge. When the intake valve opens, there is, however, reverse flow at high velocity which aids in mixture preparation of the initial portion of the charge but does not eliminate the poor preparation caused by the puddling. Furthermore, it is known that during deceleration the air-fuel ratio tends to decrease because of the reduced air flow caused by the closing throttle. One reason for this is that fuel flowing along the intake passage wall cannot respond to a decrease in demand as rapidly as the air, fuel vapor and fuel droplets. On the other hand, on an acceleration, the flow of air vapor mixture will increase almost as rapidly as the throttle can be opened but the rate of fuel flow along the wall will not respond as rapidly. This results in an instantaneous increase in air-fuel ratio during acceleration and is the reason for the use of an accelerator pump in the carburetor. While the operation of the accelerator pump prevents the engine from stumbling, it also causes a rich spike in the variation of the air-fuel ratio with time and a corresponding spike in HC emissions. Furthermore, it is known that there can occur cycle-to-cycle variations in air-fuel ratio even during steady state operation because of unpredictable transient variations in liquid fuel flow from the carburetor and/or along the intake passage wall.

According to the present invention there is provided air flow sensitive fuel sink-distribution-source means in the form of a ring 28 of porous material that is permanently bonded or mechanically secured in place in a circular groove 29 in the intake passage 18 adjacent or just upstream of the intake port 20 so that it is near as possible to the head of the intake valve 22 and the entrance to the combustion chamber. The ring 28 projects radially inwardly past the intake passage wall and is effective to (1) absorb the liquid fuel flowing along the intake passage wall and more advantageously distribute the fuel around the periphery of the valve, (2) better atomize the fuel, (3) act as a fuel sink during engine deceleration and (4) act as a fuel source during acceleration. Suitable materials for the ring 28 include a porous metal such as sintered bronze, a foamed plastic and compacted fine wire mesh. In the preferred embodiment, the ring 28 is a right circular ring completely surrounding the intake port to provide equal fuel distribution thereabout. However, it will be appreciated that an unsymmetrical ring or a partial ring could be used to deliver unequal distribution if so desired depending on the particular installation. Now as the rivulets of fuel flow along the intake passage wall 18, they are intercepted and absorbed by the ring 28. In the absorbtion process the fuel is distributed through the ring and thus about the intake port 20 and valve head 24. As a result, the air rushing therepast during valve opening picks up a distributed liquid fuel supply from the intake passage wall thereby providing a more evenly distributed charge over the open intake port area and in addition providing better atomization of the liquid from the wall. Furthermore, the fuel that heretofore tended to puddle during valve closure is also absorbed and distributed around the periphery of the valve for better mixture preparation of the initial portion of the charge during subsequent valve opening.

The flow of fuel from the porous metal ring 28 is determined by the rate of the air flow therepast and thus the ring 28 operates as a sink during deceleration when the air flow is reduced by closing the throttle since the rate of liquid fuel flow from the porous ring will then be immediately reduced. On the other hand, on acceleration the flow of air vapor mixture will increase with the opening throttle and thus the flow of fuel from the ring 28 will increase and at a rate which increases with increasing velocity which is desirable to meet the higher loads. Furthermore, it will be appreciated that the ring 28 also tends to reduce cycle-to-cycle variations in air-fuel ratio during steady state operation by its ability to act as both a sink and a source thereby dampening out transient variations in liquid fuel flow from the carburetor and/or along the intake passage wall. Furthermore, it is believed that the ring 28 can reduce heat addition through a hot spot in the intake passage to the intake manifold by permitting acceptable performance with more fuel in the intake passage wall layer. Less manifold heat addition would permit better engine volumetric efficiency and improved engine torque. Of course, the exact shape, volume and porosity of the ring 28 to best serve the requirements of absorbing the liquid fuel flowing along the walls and distributing it around the intake port and acting both as a fuel sink during engine deceleration and as a source during acceleration would be determined for the particular engine.

Figure 2:
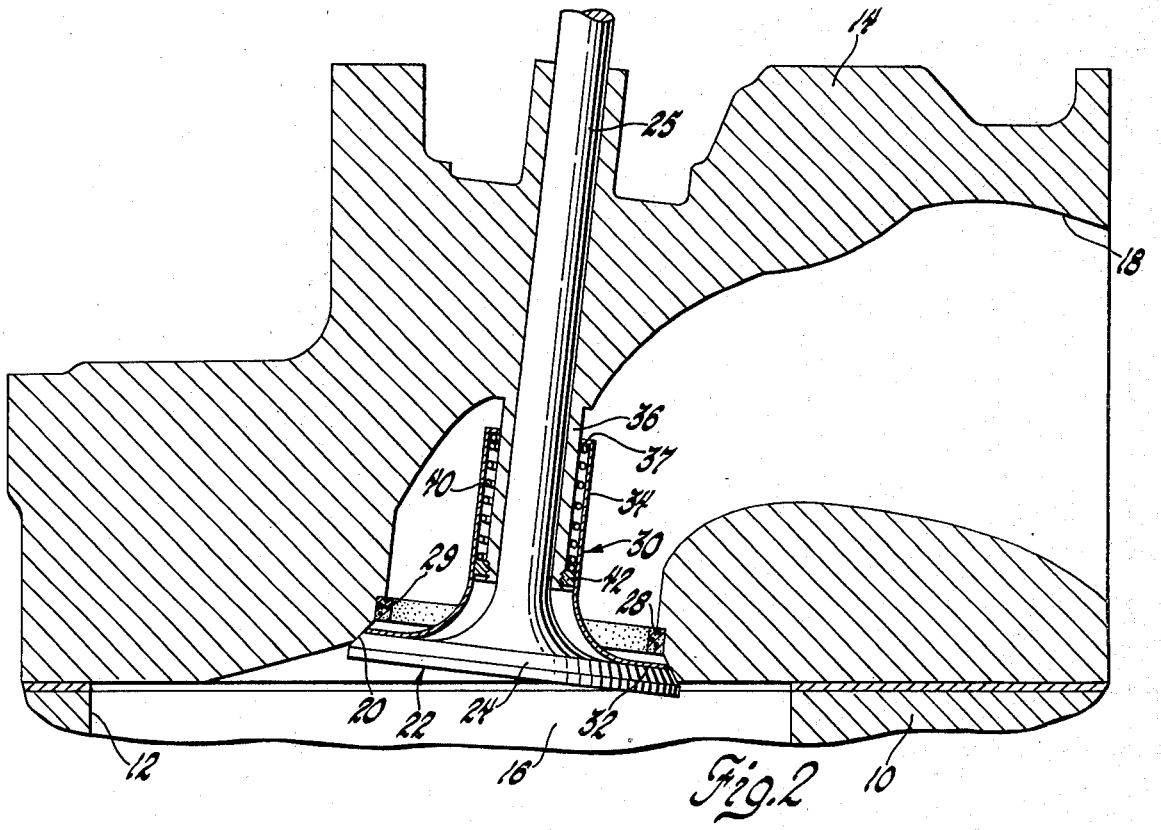
FIG. 2 is a view similar to FIG. 1 showing another embodiment of the fuel control arrangement according to the present invention.

Recognizing that reverse flow of hot gases through the intake port could result in undesirable carbon formation on the porous surface of the ring 28, there is provided as shown in FIG. 2, an auxiliary or check valve 30 which operates to prevent such reverse flow from reaching the ring. The valve 30 is simply a sheet metal stamping of annular shape that fits about the intake valve stem 25 and has a head 32 at the lower end which is seatable on the intake port valve seat 20 just upstream of where the intake valve seats. The check valve 30 has a tubular section 34 which extends upward and about the cylindrical boss 36 for the intake valve stem and terminates with a radially inwardly extending flange 37. A light spring 40 is mounted in the annular space between the boss 36 and the tubular section 34 and seats at its opposite ends on the flange 37 and on a collar 42 threadably secured to the lower end of the boss. The spring 40 normally biases the check valve 30 to the closed position shown and during intake valve opening operation the pressure differential thereacross is normally sufficient to overcome this spring force to permit it to open with the intake valve. However, should hot gases attempt to flow out through the intake port while the intake valve is open, the attendant reversal in pressure differential together with the spring force will cause the check valve to close and thus prevent the hot gases from reaching the ring 28.

While the invention has been shown in a reciprocating piston engine it will also be understood that the invention can be used in a rotary engine where the intake port may be in either side walls and/or peripheral wall and the rotor controls the opening of the intake port. Typically the shape of the intake port in the rotary engine is a noncircular shape and the ring would, of course, be conformed accordingly.

The above described embodiments are illustrative of the invention which may be modified within the scope of the appended claims.

I claim:

1. An internal combustion engine having a combustion chamber, an intake passage terminating at an intake port open to said chamber, a valve seat in said intake port, valve means for opening and closing said intake port at said valve seat, means for delivering a controlled supply of fuel and air to said intake passage wherein during engine operation fuel passes through said intake passage to said intake port as a vapor, as suspended liquid droplets and as a liquid film along the intake passage surface, and porous material means of predetermined porosity throughout arranged in and about said intake passage adjacent to and upstream of said valve seat for intercepting the liquid film adjacent the upstream side of said valve seat and accumulating this fuel on reduced air flow and releasing the accumulated fuel to said intake port on increased air flow while distributing the accumulated fuel about said intake port.

2. An internal combustion engine having a combustion chamber, an intake passage terminating at an intake port open to said chamber, a valve seat in said intake port, valve means for opening and closing said intake port at said valve seat, means for delivering a controlled supply of fuel and air to said intake passage wherein during engine operation fuel passes through said intake passage to said intake port as a vapor, as suspended liquid droplets and as a liquid film along the intake passage surface, and an annular member of predetermined porosity throughout arranged in and about said intake passage adjacent to and upstream of said valve seat for intercepting the liquid film adjacent the upstream side of said valve seat and accumulating this fuel on reduced air flow and releasing the accumulated fuel to said intake port on increased air flow while distributing the accumulated fuel about said intake port.

3. An internal combustion engine having a combustion chamber, an intake passage terminating at an intake port open to said chamber, a valve seat in said intake port, valve means for opening and closing said intake port at said valve seat, means for delivering a controlled supply of fuel and air to said intake passage wherein during engine operation fuel passes through said intake passage to said intake port as a vapor, as suspended liquid droplets and as a liquid film along the intake passage surface, porous material means of predetermined porosity throughout arranged in and about said intake passage adjacent to and upstream of said valve seat for intercepting the liquid film adjacent the upstream side of said valve seat and accumulating this fuel on reduced air flow and releasing the accumulated fuel to said intake port on increased air flow while distributing the accumulated fuel about said intake port, and check valve means for preventing gases from said chamber from reaching and forming carbon on said porous material means while said intake port is open.

* * * * *